US007744083B2

(12) United States Patent
Kang

(10) Patent No.: US 7,744,083 B2
(45) Date of Patent: Jun. 29, 2010

(54) PAPER FEEDING APPARATUS

(75) Inventor: Hoon Kang, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 359 days.

(21) Appl. No.: 11/354,937

(22) Filed: Feb. 16, 2006

(65) Prior Publication Data

US 2006/0220301 A1 Oct. 5, 2006

(30) Foreign Application Priority Data

Apr. 4, 2005 (KR) ..... 10-2005-0027943

(51) Int. Cl.
*B65H 1/08* (2006.01)

(52) U.S. Cl. ..... 271/127; 271/126

(58) Field of Classification Search ..... 271/126, 271/127, 109

See application file for complete search history.

(56) References Cited

U.S. PATENT DOCUMENTS 5,228,676 A * 7/1993 Arai et al. ..... 271/117
5,228,677 A * 7/1993 Asakawa ..... 271/126
5,383,654 A * 1/1995 Iseda ..... 271/9.05
5,386,982 A * 2/1995 Kawano ..... 271/10.04
5,678,814 A * 10/1997 Yokoyama et al. ..... 271/9.05
5,775,686 A * 7/1998 Miyake ..... 271/127
6,056,285 A * 5/2000 Kikuta et al. ..... 271/118
6,257,569 B1 * 7/2001 Rhodes et al. ..... 271/117
6,422,773 B1 * 7/2002 Lim ..... 400/710
6,783,126 B2 * 8/2004 Amamoto ..... 271/152
7,458,571 B2 * 12/2008 Ogawa ..... 271/118
7,513,496 B2 * 4/2009 Hattori ..... 271/127
2003/0071412 A1 * 4/2003 Kimura et al. ..... 271/306

(Continued)

FOREIGN PATENT DOCUMENTS

EP 246703 A1 * 11/1987

(Continued)

OTHER PUBLICATIONS

Notice of Official Action issued Apr. 25, 2006 by the Korean Intellectual Property Office re: Korean Application No. 2005-27943 (3 pp).

*Primary Examiner*—Patrick Mackey
*Assistant Examiner*—Patrick Cicchino
(74) *Attorney, Agent, or Firm*—Staas & Halsey LLP

(57) ABSTRACT

A paper feeding apparatus is provided for use in an image forming apparatus. Such a paper feeding apparatus comprises a knock-up plate rotating upwardly and downwardly with a first end thereof provided as a hinge shaft, a driving motor and a paper feeding roller assembly to withdraw a single sheet of paper stacked on the knock-up plate by a driving a force from the driving motor, and further comprises a lift gear unit to upwardly rotate the knock-up plate by the driving force intermittently transmitted from the driving motor through a connecting means; a position sensor arranged to detect whether the sheets of paper stacked on the knock-up plate reaches a predetermined height proper to be fed to the paper feeding roller assembly; and a controller arranged to control the connecting means to be turned on and off based on a signal detected from the position sensor. As a result, a single driving motor is utilized to feed papers and drive a knock-up plate, thereby reducing production costs and enhancing internal space efficiency.

14 Claims, 5 Drawing Sheets

U.S. PATENT DOCUMENTS

| | | | | |
|---|---|---|---|---|
| 2004/0041333 | A1* | 3/2004 | Izumi et al. | 271/145 |
| 2004/0135304 | A1* | 7/2004 | Tokunaga et al. | 271/3.01 |
| 2005/0040588 | A1 | 2/2005 | Chang | |
| 2005/0087921 | A1* | 4/2005 | Aoki et al. | 271/126 |
| 2005/0218584 | A1* | 10/2005 | Dan | 271/127 |
| 2006/0071402 | A1* | 4/2006 | Takasaka et al. | 271/126 |
| 2006/0115308 | A1* | 6/2006 | Hattori | 399/393 |
| 2009/0134566 | A1* | 5/2009 | Sumi | 271/109 |

FOREIGN PATENT DOCUMENTS

| | | | |
|---|---|---|---|
| JP | 57107339 | * | 7/1982 |
| JP | 62211228 | * | 9/1987 |
| JP | 06001472 | * | 1/1994 |
| JP | 06127709 | * | 5/1994 |
| JP | 7-242349 | | 9/1995 |
| JP | 2003-2459 | | 1/2003 |
| KR | 86-13158 | | 11/1986 |
| KR | 92-14926 | | 8/1992 |
| KR | 2005-19416 | | 3/2005 |

* cited by examiner

PAPER FEEDING APPARATUS

CROSS-REFERENCE TO RELATED APPLICATIONS

This application claims all benefits accruing under 35 U.S.C. §119 of Korean Patent Application No. 2005-27943, filed on Apr. 4, 2005, in the Korean Intellectual Property Office, the disclosure of which is incorporated by reference herein.

BACKGROUND OF THE INVENTION

1. Field of the Invention

The present invention relates to a paper feeding apparatus, and more particularly, to a paper feeding apparatus for use in an image forming apparatus, which advantageously utilizes a single driving source to drive both a knock-up plate and a paper feeding roller assembly at the same time.

2. Related Art

Generally, a paper feeding apparatus is included as part of an image forming apparatus, such as a printer, a facsimile machine, a photocopier and a multi-functional product, for feeding individual sheets of print media such as papers into the image forming apparatus. As shown in FIG. 1, a typical multi-functional product 100 comprises an image former 110 to form an image on a paper 1; an image reader 120 coupled to an upper part of the image former 110 to read documents and transfer image data to the image former 110; and a paper feeding apparatus 130 provided on a lower part of the image former 110 to feed individual sheets of paper 1 from a paper feeding cassette 140 to the image former 110. The image reader 120 includes an image reading table 122, typically of a flatbed type, to accommodate different standard sized papers, and an automatic document feeder (ADF) 124 to automatically feed individual sheets of paper to be read to the image reader 120. In addition, a housing 101 is provided to house the image former 110, the paper feeding apparatus 130, the paper feeding cassette 140 and related components, along with a control panel 103 provided with a controller (not shown) for controlling operation of the image former 110, the image reader 120, the paper feeding apparatus 130 and other components, as well as a display panel 105 for providing visual display of operation. Each paper 1 which is stacked on a knock-up plate 131 of the paper feeding apparatus 130 is picked up by a pick-up roller 201 to be supplied to a paper feeding roller 202. Meanwhile, a reverse roller 204 rotates corresponding to the paper feeding roller 202, and enables the paper 1 to be supplied as a single sheet to the image former 110. The paper 1 which passes through the paper feeding roller 202 and the reverse roller 204 is conveyed by conveying rollers 142 and has an image transferred onto it by a photosensitive drum 111 and a transfer roller 112 of the image former 110. Then, the transferred image is fused on the paper by fixing rollers 113. After fusing, the paper 1 is ejected to the outside through an outlet 114. The image former 110 is positioned inside the housing 101, whereas the paper feeding cassette 140 is removable from the housing 101.

FIG. 2 is a schematic view illustrating a driving relation of a paper feeding apparatus 130 used in the multi-functional product shown in FIG. 1. A driving source of the paper feeding apparatus 130 comprises a main driving motor 210 for driving a pick-up roller 201, a paper feeding roller 202 and a reverse roller 204; and a lift motor 220 for driving a lift gear 221, a partial gear 222 and a lift bar 223 to rotate upwardly the knock-up plate 131 for picking up individual sheet of paper 1 to be fed into the image former 110 for image formation. The main driving motor 210 drives the paper feeding roller 202 and the reverse roller 204 through a plurality of gears 211 and a pick-up clutch 212, and drives the pick-up roller 201 through a transmission gear 206. The lift motor 220 rotates a partial gear 222 through a lift gear 221 such that the partial gear 222 can rotate a lift bar 223 fixed with the same shaft, so as to enable the knock-up plate 131 to rotate upwardly.

The knock-up plate 131, the pick-up roller 201, the partial gear 222 and the lift bar 223 of the paper feeding apparatus 130 in FIG. 1 are mounted to the paper feeding cassette 140. A paper feeding gear 203 and a reverse gear 205 are fixed on the same shaft as the paper feeding roller 202 and the reverse roller 204, respectively to enable individual sheet of paper 1 to be fed into the image former 110 for image formation.

As shown in FIG. 2, the paper feeding apparatus 130 requires separate and independent driving sources to feed individual sheet of paper 1 into the image former 110. Specifically, the paper feed apparatus 130 requires a main driving motor 210 as the driving source to drive the pick-up roller 201, the paper feeding roller 202 and the reverse roller 204; and a lift motor 220 as the driving source to drive the knock-up plate 131, respectively. However, the installation of two independent motors can increase the production cost significantly. Moreover, the double installation of the motors can also be bulky which tends to lower space efficiency of an image forming apparatus such as a multi-functional product. Accordingly, there is a need to provide a paper feeding apparatus for use in an image forming apparatus which advantageously utilizes a single driving source to drive both a knock-up plate and a paper feeding roller assembly at the same time so as to reduce production costs and promote internal space efficiency.

SUMMARY OF THE INVENTION

Various aspects and example embodiments of the present invention advantageously provide a paper feeding apparatus for use in an image forming apparatus which advantageously utilizes a single driving motor to feed papers and to drive a knock-up plate at the same time, so as to reduce production costs and maximize internal space efficiency.

Additional aspects and/or advantages of the invention will be set forth in part in the description which follows and, in part, will be obvious from the description, or may be learned by practice of the invention.

In accordance with an aspect of the present invention a paper feeding apparatus is provided with a knock-up plate rotating upwardly and downwardly with a first end thereof provided as a hinge shaft; a driving motor and a paper feeding roller assembly to withdraw an individual sheet of paper stacked on the knock-up plate by a driving a force from the driving motor, and further comprises a lift gear unit to rotate the knock-up plate upwardly by the driving force intermittently transmitted from the driving motor through connecting means; a position sensor arranged to detect whether sheets of paper stacked on the knock-up plate reaches a predetermined height proper to be fed to the paper feeding roller assembly; and a controller arranged to control the connecting means to be turned on and off based on a signal detected from the position sensor.

According to an aspect of the present invention, the connecting means comprises a lift clutch. In addition, a one-way gear is also installed to receive the driving force from the connecting means and transmit the driving force to the lift gear unit. Similarly, a driving gear is provided to be engaged with the one-way gear to rotate and formed with a first clutch on a side thereof; and a follower gear is formed with a second clutch correspondingly coupled to the first clutch on a side thereof to rotate by being engaged with the lift gear unit.

According to an aspect of the present invention, the paper feeding apparatus further comprises a housing to accommodate and support the driving motor, the connecting means, the one-way gear and the driving gear; and a paper feeding cassette to accommodate and support the follower gear, the lift gear unit and the knock-up plate to be detachably coupled to the housing to couple and separate the first clutch of the driving gear and the second clutch of the follower gear. A distribution gear is further installed to receive the driving force from the driving motor and transmit the driving force to the paper feeding roller assembly and the connecting means at the same time.

According to another aspect of the present invention, a paper feeding apparatus for use in an image forming apparatus is provided with a knock-up plate arranged to support print media, and to rotate about a distal end in an upward/downward direction; a feed roller assembly arranged to pick-up and feed each individual sheet of print media stacked on the knock-up plate for an image forming operation; a lift gear assembly arranged to lift the knock-up plate in an upward direction such that the feed roller assembly can pick-up and feed each individual sheet of print media stacked on the knock-up plate for the image forming operation; and a single driving motor arranged to drive both the feed roller assembly and the lift gear assembly.

In addition, the paper feeding apparatus is further provided with a position sensor arranged to detect a position of the knock-up plate and to generate a signal indicating the position of the knock-up plate; a lift clutch arranged to engage/disengage the feed roller assembly to the lift gear assembly; and a controller configured to control operation of the lift clutch to engage/disengage the feed roller assembly to the lift gear assembly based on the signal indicating the position of the knock-up plate. Furthermore, a one-way gear can be arranged to receive a driving force from the driving motor and transmit the driving force to the lift gear assembly to lift the knock-up plate in the upward direction, while preventing the knock-up plate from being pushed in a downward direction. Similarly, a driving gear can be engaged with the one-way gear, and a follower gear can be coupled to the driving gear for enabling the lift gear assembly to lift the knock-up plate in the upward direction.

The feed roller assembly comprises a pick-up roller to pick up each individual sheet of print media from the knock-up plate; and a feed roller and a reverse roller arranged to feed each individual sheet of print media picked-up for the image forming operation, wherein the pick-up roller, the feed roller and the reverse roller are driven by the driving motor, via supporting gears and a pick-up clutch.

The lift gear assembly comprises a lift bar positioned underneath the knock-up plate to lift the knock-up plate in an upward direction; a partial gear fixed on the same shaft of the lift bar, to rotate the lift bar so as to lift the knock-up plate in the upward direction; and a lift gear engaged with the partial gear, to rotate the partial gear so as to lift the knock-up plate in the upward direction.

According to yet another aspect of the present invention, an image forming apparatus is provided with an image former arranged to form an image on each individual sheet of print media fed from the knock-up plate; a paper feeding cassette having a knock-up plate arranged to support print media and to rotate about a distal end in an upward/downward direction, and a lift gear assembly arranged to lift the knock-up plate in an upward direction; a feed roller assembly arranged to pick-up and feed each individual sheet of print media stacked on the knock-up plate into the image former; and a main driving motor arranged to drive both the feed roller assembly and the lift gear assembly. The image forming apparatus is further provided with a position sensor arranged to detect a position of the knock-up plate and to generate a signal indicating the position of the knock-up plate; a lift clutch arranged to engage/disengage the feed roller assembly to the lift gear assembly; and a controller configured to control operation of the lift clutch to engage/disengage the feed roller assembly to the lift gear assembly based on the signal indicating the position of the knock-up plate. A one-way gear can also be arranged to receive a driving force from the driving motor and transmit the driving force to the lift gear assembly to lift the knock-up plate in the upward direction, while preventing the knock-up plate from being pushed in a downward direction. Likewise, a driving gear can be engaged with the one-way gear, and a follower gear can be coupled to the driving gear for enabling the lift gear assembly to lift the knock-up plate in the upward direction.

In accordance with an aspect of the present invention, the lift gear assembly is provided with a lift bar positioned underneath the knock-up plate to lift the knock-up plate in an upward direction; a partial gear fixed on the same shaft of the lift bar, to rotate the lift bar so as to lift the knock-up plate in the upward direction; and a lift gear engaged with the partial gear, to rotate the partial gear so as to lift the knock-up plate in the upward direction.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
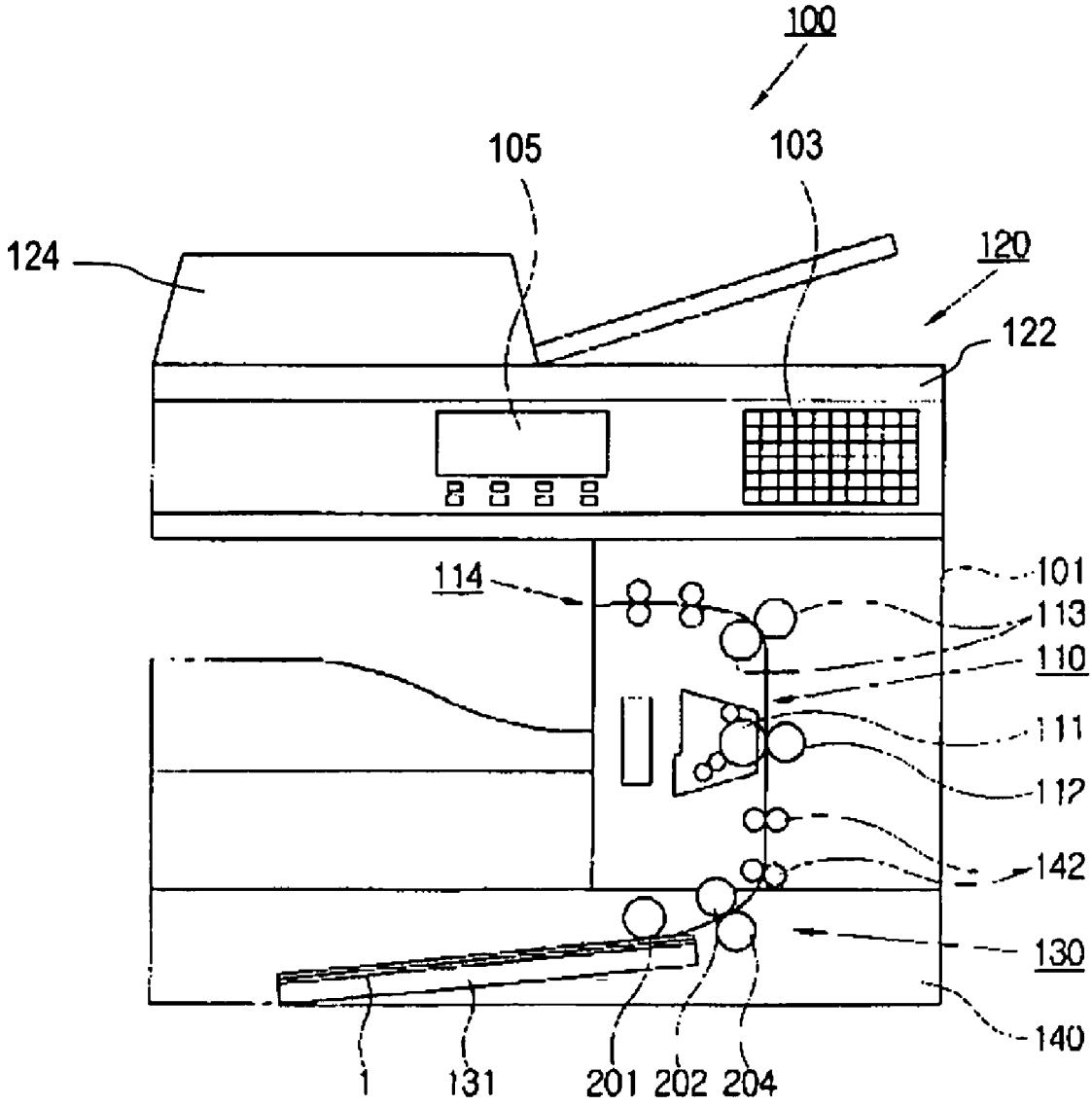
FIG. 1 (RELATED ART)
FIG. 1 is a front view of a typical multi-functional product.
Figure 2:
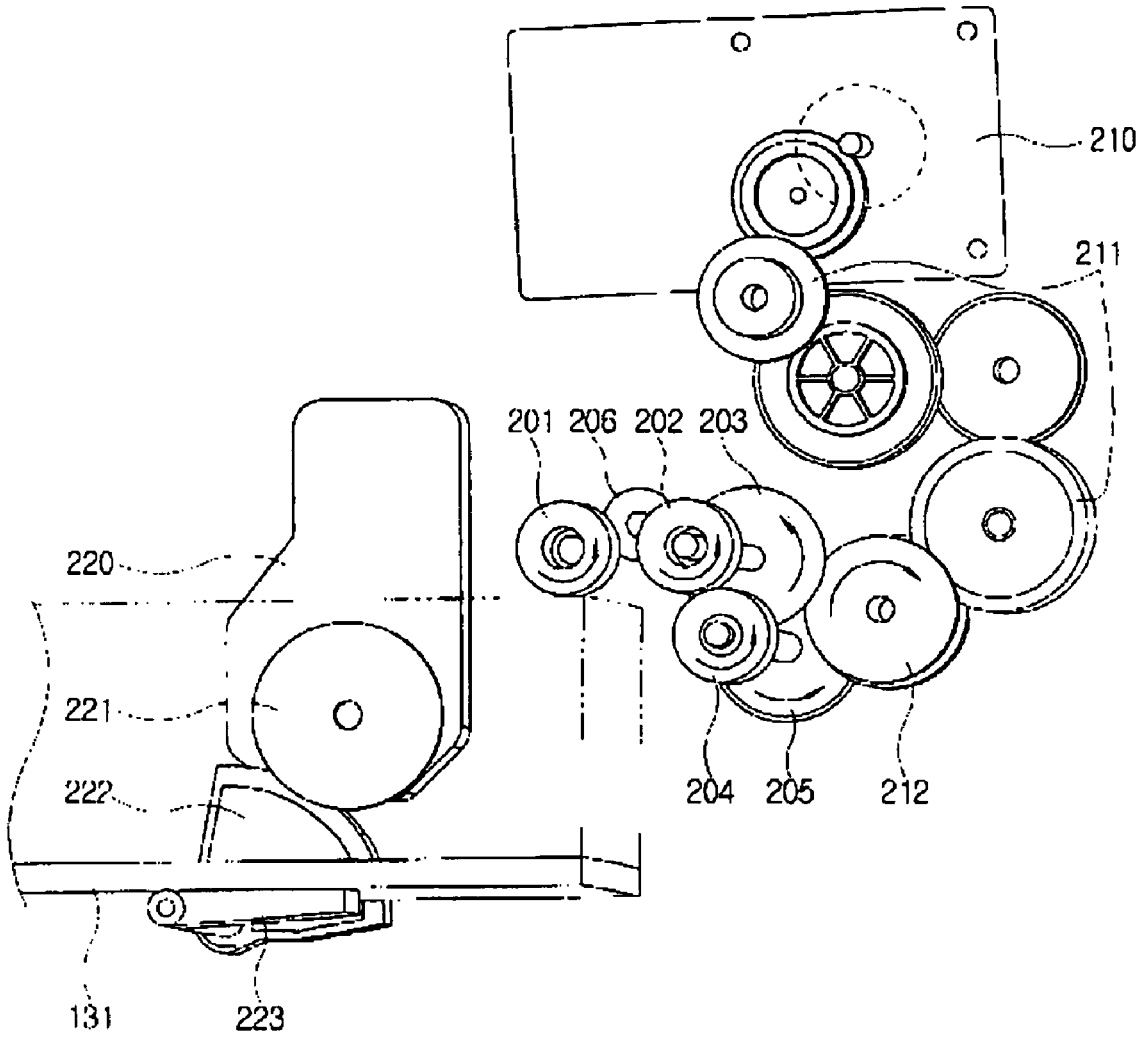
FIG. 2 (RELATED ART)
FIG. 2 is a schematic view illustrating a driving relation of a paper feeding apparatus used in the multi-functional product shown in FIG. 1.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 3:
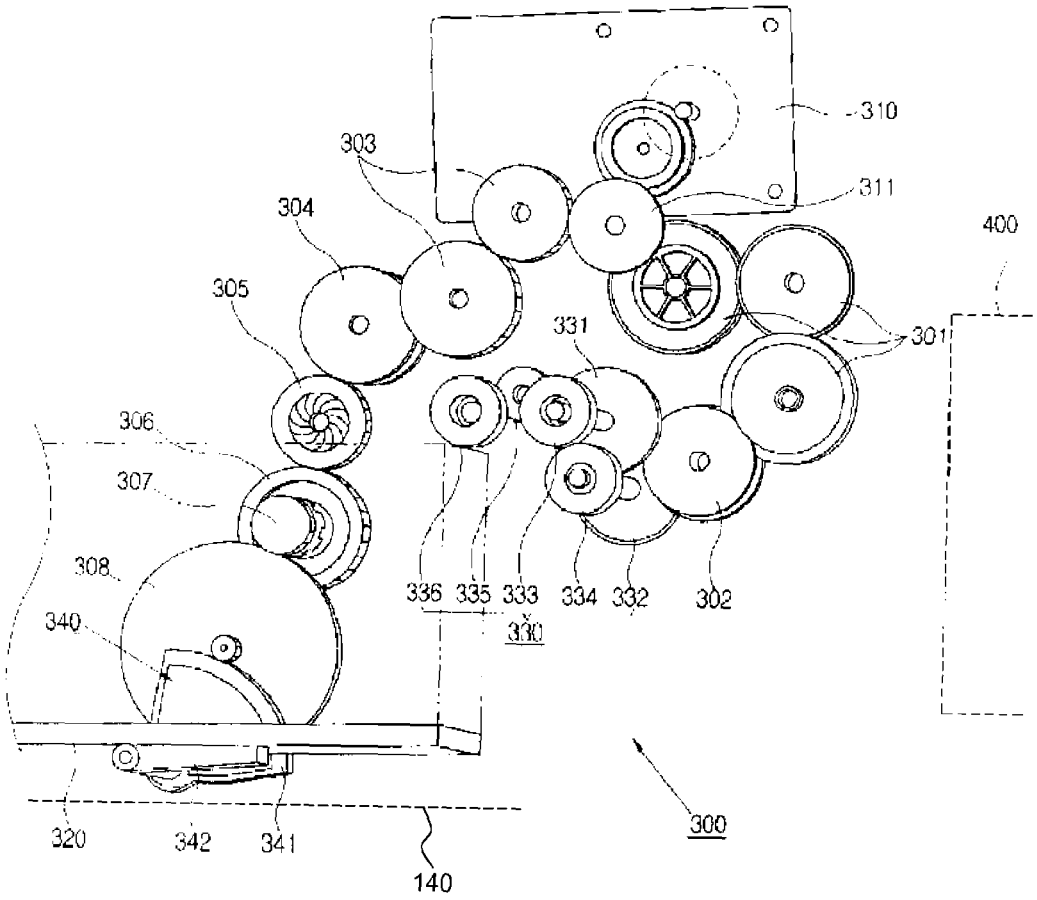
FIG. 3 is a schematic view illustrating a driving relation of a paper feeding apparatus according to an embodiment of the present invention.

Attention now is directed to the drawings and particularly to FIG. 3 in which a paper feeding apparatus for use in an image forming apparatus according to an embodiment of the present invention is illustrated. As shown in FIG. 3, a paper feeding apparatus 300 comprises a driving motor 310; a paper feeding roller assembly 330 to eject each individual sheet of paper 1 on a knock-up plate 320 through a driving force received from the driving motor 310; and a lift gear unit 340 to upwardly rotate the knock-up plate 320 through the driving force received from the driving motor 310. Here, a first end of the knock-up plate 320 is provided as a hinge shaft, which can be coupled to the paper feeding cassette 140 (as shown in FIG. 1 and represented by the dashed line identified by reference numeral 140 in FIG. 3), such that the knock-up plate 320 can be rotated in an upwardly/downwardly direction. The knock-up plate 320 can be tilted about a hinge shaft (not shown) according to an amount of paper 1 stacked on a top surface of the knock-up plate 320.

The driving motor 310 is connected with a distribution gear 311, and the driving force of the driving motor 310 is transmitted to the paper feeding roller assembly 330 and the lift gear unit 340 through the distribution gear 311.

The distribution gear 311 is connected with a pick-up clutch 302 through a plurality of gears 301, and drives a paper feeding gear 331 and a reverse gear 332 of the paper feeding roller assembly 330 according to control of the pick-up clutch 302, thereby rotating a paper feeding roller 333 and a reverse roller 334 fixed on the same shaft, respectively. By the gear coupling, the paper feeding roller 333 and the reverse roller 334 rotate in the same direction. Accordingly, the sheet of paper 1 at the bottom of the pile is moved in a reverse direction by a friction force, thereby preventing the sheets of paper 1 from being overlapped during the paper feeding process.

The paper feeding gear 333 drives a transmission gear 335, thereby driving the pick-up roller 336, which is engaged with the transmission gear 335 to rotate. Accordingly, the pick-up roller 336 rotates in the same direction as the paper feeding roller 333, and picks up each piece of paper 1 at the top of the pile stacked on the knock-up plate 320 to move the same to the paper feeding roller 333 and the reverse roller 334. Each sheet of paper 1 picked up from the pick-up roller 336 is moved to the image former 110 through the paper feeding roller 333.

Meanwhile, a controller (not shown in FIG. 3, but shown in FIG. 5) is arranged to control operation of the pick-up clutch 302 so as to be locked and unlocked. As a result, the paper feeding roller assembly 330, which is controlled by the pick-up clutch 302, can be driven, and the individual sheets of paper 1 are fed into the image former 110, intermittently for image forming operations.

The distribution gear 311 is engaged with supporting gears 303 to transmit the driving force to the lift gear unit 340, separately from the supporting gears 301 to transmit the driving force to the paper feeding roller assembly 330. The driving force transmitted through the plurality of gears 303 is transmitted to a one-way gear 305 according to control of a lift clutch 304 which serves as a connecting means. The one-way gear 305 rotates in only one direction, and is used to rotate in a direction to upwardly rotate the knock-up plate 320 according to an embodiment of the present invention. The one-way gear 305 is engaged with a driving gear 306 to rotate, and the driving gear 306 is clutch-coupled with a follower gear 307 to rotate on the same shaft. With the clutch coupling, a first clutch which is provided in the driving gear 306 and a second clutch which is provided in the follower gear 307 may be separated and coupled from/to each other. The follower gear 307, the lift gear 308 and the lift gear unit 340 may be installed in a paper feeding cassette 140 (as shown in FIG. 1 and represented by the dashed line identified by reference numeral 140 in FIG. 3) by the coupling structure. That is, the paper feeding cassette 140 accommodates and supports the knock-up plate 320, the lift gear unit 340, the lift gear 308 and the follower gear 307. If the paper feeding cassette 140 is inserted into a main body housing 101 (as shown in FIG. 1), the follower gear 307 of the paper feeding cassette 140 may be engaged with the driving gear 306 of the main body housing 101.

The follower gear 307 rotates the lift gear 308 which is coupled therewith, and the lift gear 308 is engaged with a partial gear 341 of the lift gear unit 340 to rotate. Accordingly, a lift bar 342 which rotates on the same shaft with the partial gear 341 rotates, thereby upwardly rotating the knock-up plate 320. The lifted knock-up plate 320 is prevented from being downwardly rotated by the one way gear 305. Meanwhile, the knock-up plate 320 is downwardly rotated as the paper feeding cassette 140 (as shown in FIG. 1 and represented by the dashed line identified by reference numeral 140 in FIG. 3) which accommodates and supports the knock-up plate 320, is separated from the main body housing 101 (as shown in FIG. 1). That is, while the one-way gear 305 prevents the knock-up plate 320 from being downwardly rotated, the clutch-coupling of the driving gear 306 and the follower gear 307 is unlocked if the paper feeding cassette 140 is separated from the main body housing 101. Then, the knock-up plate 320 is downwardly rotated by self-weight automatically.

Also, according to an embodiment of the present invention, a position sensor 350 (shown in FIG. 5) is positioned above the knock-up plate 320 so as to detect the rise of the knock-up plate 320.

Figure 4:
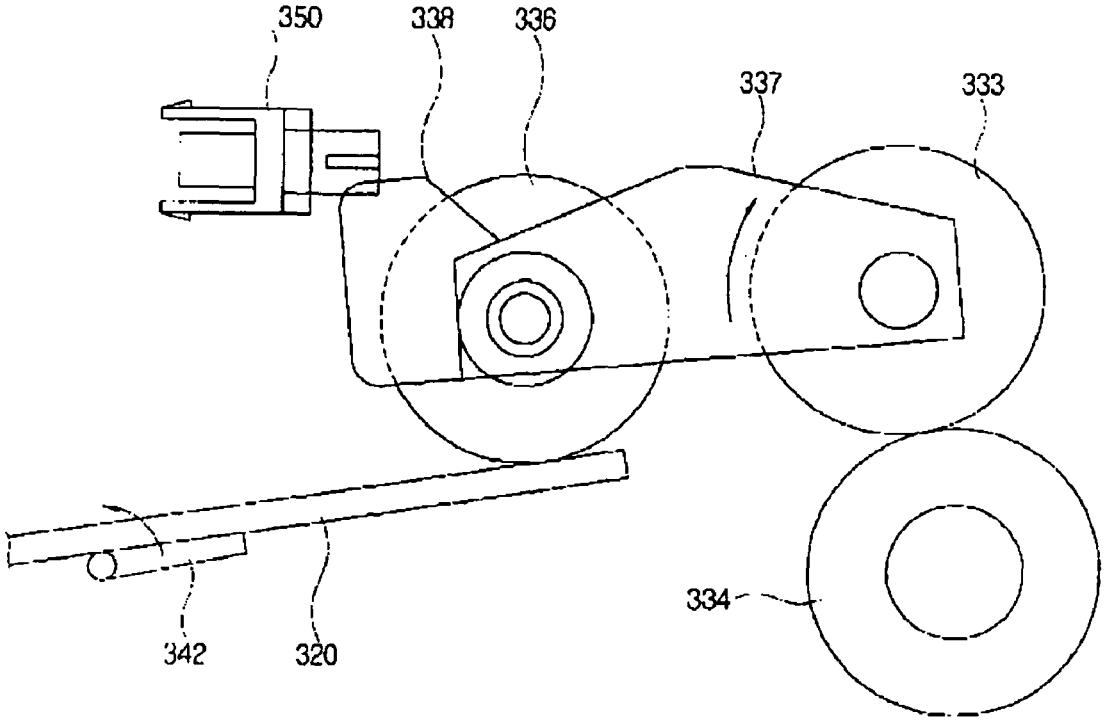
FIG. 4 is an enlarged view of an operation state of the paper feeding apparatus shown in FIG. 3.

Turning now to FIG. 4, an enlarged view of an operation state of the paper feeding roller assembly 330 according to an embodiment of the present invention is illustrated. As shown in FIG. 4, a pick-up bracket 337 is provided to secure both the paper feeding roller 333 which is coupled to the reverse roller 334, and the pick-up roller 336 which is positioned to pick-up each individual sheet of paper 1 from the knock-up plate 320. An extender 338 is fixed on the pick-up bracket 337 to support rotation of the pick-up roller 336 and the paper feeding roller 333 (as shown in FIG. 3). A position sensor 350 is positioned to detect the position of the pick-up roller 336, via the extender 338. In operation, the pick-up roller 336 of the paper feeding roller assembly 330, which is in contact with the knock-up plate 320, specifically, the individual sheet of paper 1 at the top of the pile stacked on the knock-up plate 320, rotates around a rotation shaft of the paper feeding roller 333 with the rise (elevation) of the knock-up plate 320. At this time, the extender 338 is formed on a first side of a pick-up bracket 337 to support rotation of the pick-up roller 336 and the paper feeding roller 333. The position sensor 350 is fixed to where the extender 338 is detected to determine if the pick-up roller 336 is properly disposed for picking up the sheets of paper 1. If the knock-up plate 320 is lifted up by rotation of the lift bar 342 to push the pick-up roller 336 in an upward direction, the extender 338 of the pick-up bracket 337 is detected by the position sensor 350 and the lift bar 342 stops operating.

Figure 5:
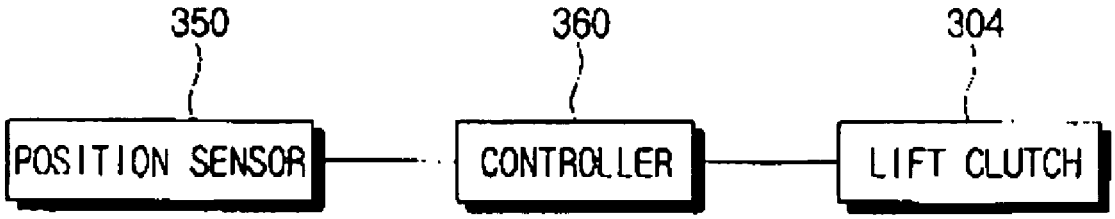
FIG. 5 is a block diagram to realize the operation state of the paper feeding apparatus shown in FIG. 4.

FIG. 5 is a block diagram illustrating a control relation between the position sensor 350 and the lift bar 342 according to an embodiment of the present invention. If the pick-up roller 336 reaches a predetermined height by upward rotation of the knock-up plate 320, the position sensor 350 detects the upward rotation of the knock-up plate 320 based on the movement of the pick-up roller 336. The controller 360 then controls the lift clutch 304 to be turned off based on a detected signal from the position sensor 350. If the lift clutch 304 is turned off, the lift bar 342 is not driven since the driving force from the driving motor 310 is not transmitted to the lift gear unit 340. Since the driving force applied to the lift bar 342 in a downward direction by gravity acting on the knock-up plate 320 is resisted by the one-way gear 305 through the lift gear 308, the follower gear 307 and the driving gear 306, the knock-up plate 320 remains stopped even if the driving force is cut off. Also, as the sheets of papers stacked on the knock-up plate 320 are fed out, the pick-up roller 336, which is elastically biased in a direction of the knock-up plate 320, rotates downward during the paper feeding process. Accordingly, the extender 338 moves out of position with respect to the position sensor 350, and the controller 360 controls the lift clutch 304 to be turned on again to lift up the knock-up plate 320 to a proper height.

Also, the number of the gears 301 or 303 used for transmitting the driving force may be set according to position relation between the driving motor 310, the knock-up plate 320 and the paper feeding roller assembly 330.

As described from the foregoing, the present invention advantageously provide a paper feeding apparatus for use in an image forming apparatus which advantageously utilizes a single driving source to drive both a knock-up plate and a paper feeding roller assembly at the same time to reduce production costs and promote internal space efficiency. The transmission of the driving force is performed by the gear coupling, as shown in FIG. 3 and FIG. 4. However, belt-pulley coupling can be alternatively used to drive both the knock-up plate and the paper feeding roller assembly at the same time.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, the components of the paper feeding roller assembly 330 and the lift gear unit 340 as shown in FIG. 3 and FIG. 4 can be implemented differently, as long as their respective operations can be driven by a single driving source. Moreover, the transmission of a driving force for all or part thereof may be performed by belt-pulley coupling. Accordingly, it is intended, therefore, that the present invention not be limited to the various example embodiments disclosed, but that the present invention includes all embodiments falling within the scope of the appended claims.

What is claimed is:

1. A paper feeding apparatus comprising:

a knock-up plate for rotating upwardly and downwardly with a first end thereof provided as a hinge shaft;

a driving motor;

a paper feeding roller assembly for feeding each individual sheet of paper stacked on the knock-up plate by a driving a force from the driving motor;

a lift gear unit arranged to upwardly rotate the knock-up plate by the driving force intermittently transmitted from the driving motor through connecting means;

a position sensor arranged to detect whether the individual sheets of paper stacked on the knock-up plate reaches a predetermined height suitable to be fed to the paper feeding roller assembly;

a controller arranged to control operation of the connecting means based on a signal detected from the position sensor so as to enable transmission of the driving force from the driving motor to the lift gear unit;

a one-way gear arranged to receive the driving force from the driving motor, via said connecting means, and transmit the driving force to the lift gear unit;

a driving gear arranged to be engaged with the one-way gear to rotate and formed with a first clutch on a side thereof; and a follower gear formed with a second clutch correspondingly coupled to the first clutch on a side thereof to rotate by being engaged with the lift gear unit.

2. The paper feeding apparatus according to claim 1, further comprising:

a housing to accommodate and support the driving motor, the connecting means, the one-way gear, and the driving gear; and a paper feeding cassette mounted to the housing to accommodate and support the follower gear, the lift gear unit, and the knock-up plate.

3. The paper feeding apparatus according to claim 1, further comprising a distribution gear to receive the driving force from the driving motor and transmit the driving force to the paper feeding roller assembly and the connecting means at the same time.

4. The paper feeding apparatus according to claim 1, wherein the one-way gear transmits the received driving force from the driving motor to the lift gear unit only during a knock-up plate raising operation to rotate the knock-up plate in the upward direction, and hold the knock-up plate in a raised position when the knock-up plate raising operation is not being performed to prevent the knock-up plate from being pushed in a downward direction.

5. The paper feeding apparatus according to claim 4, wherein the connecting means comprises a lift clutch to engage/disengage the paper feeding roller assembly with/from the lift gear unit.

6. The paper feeding apparatus according to claim 4, wherein the paper feeding roller assembly comprises:

a pick-up roller to individually pick up each sheet of the paper stacked on the knock-up plate; and a feed roller and a reverse roller to individually feed each sheet of the paper picked up by the pick-up roller;

wherein the pick-up roller, the feed roller, and the reverse roller are driven by the driving motor via supporting gears and a pick-up clutch.

7. The paper feeding apparatus according to claim 4, wherein the lift gear unit comprises:

a lift bar mounted underneath the knock-up plate to rotate the knock-up plate in the upward direction;

a partial gear mounted on a same shaft as the lift bar to rotate the lift bar to cause the lift bar to rotate the knock-up plate in the upward direction; and a lift gear engaged with the partial gear to rotate the partial gear to cause the partial gear to rotate the lift bar to cause the lift bar to rotate the knock-up plate in the upward direction.

8. The paper feeding apparatus according to claim 7, wherein the lift gear unit and the knock-up plate are mounted in a paper feeding cassette.

9. An image forming apparatus comprising:

an image forming device to form an image on print media;

a print media feeding cassette comprising:

a knock-up plate to support the print media, the knock-up plate being rotatable about one end thereof in an upward/downward direction; and a lift gear assembly to rotate the knock-up plate in the upward direction during a knock-up plate raising operation;

a feed roller assembly to individually pick up and feed sheets of the print media stacked on the knock-up plate to the image forming device during an image forming operation;

a main driving motor arranged to drive the feed roller assembly during the image forming operation, and the lift gear assembly during the knock-up plate raising operation;

a one-way gear to receive a driving force from the main driving motor and transmit the received driving force to the lift gear assembly only during the knock-up plate raising operation to rotate the knock-up plate in the upward direction, and hold the knock-up plate in a raised position when the knock-up plate raising operation is not being performed to prevent the knock-up plate from being pushed in a downward direction;

a driving gear arranged to be engaged with the one-way gear to rotate and formed with a first clutch on a side thereof; and a follower gear formed with a second clutch correspondingly coupled to the first clutch on a side thereof to rotate by being engaged with the lift gear assembly.

10. The image forming apparatus according to claim 9, further comprising:

a position sensor to detect a position of the knock-up plate, and generate a signal indicating the position of the knock-up plate;

a lift clutch to engage/disengage the feed roller assembly with/from the lift gear assembly; and a controller to control an operation of the lift clutch to engage/disengage the feed roller assembly with/from the lift gear assembly based on the signal indicating the position of the knock-up plate.

11. The image forming apparatus according to claim 9, wherein the feed roller assembly comprises:

a pick-up roller to individually pick up the sheets of the print media stacked on the knock-up plate; and a feed roller and a reverse roller to individually feed the sheets of the print media picked up by the pick-up roller;

wherein the pick-up roller, the feed roller, and the reverse roller are driven by the main driving motor via supporting gears and a pick-up clutch.

12. The image forming apparatus according to claim 9, wherein the lift gear assembly comprises:

a lift bar mounted underneath the knock-up plate to rotate the knock-up plate in the upward direction;

a partial gear mounted on a same shaft as the lift bar to rotate the lift bar to cause the lift bar to rotate the knock-up plate in the upward direction; and a lift gear engaged with the partial gear to rotate the partial gear to cause the partial gear to rotate the lift bar to cause the lift bar to rotate the knock-up plate in the upward direction.

13. The paper feeding apparatus according to claim 1, wherein:

the knock-up plate is mounted in a paper feeding cassette insertable in and removable from a paper feeding position; and the one-way gear holds the knock-up plate in the raised position until the paper feeding cassette is removed from the paper feeding position.

14. The image forming apparatus according to claim 9, wherein:

the print media feeding cassette is insertable into and removable from the image forming apparatus; and the one-way gear holds the knock-up plate in the raised position until the print media feeding cassette is removed from the image forming apparatus.

* * * * *